US006179231B1

(12) United States Patent
Csendes

(10) Patent No.: US 6,179,231 B1
(45) Date of Patent: Jan. 30, 2001

(54) METHOD AND APPARATUS FOR COMMINUTING SOLID PARTICLES

(76) Inventor: Ernest Csendes, 514 Marquette St., Pacific Palisades, CA (US) 90272

( * ) Notice: Under 35 U.S.C. 154(b), the term of this patent shall be extended for 0 days.

(21) Appl. No.: 09/350,904

(22) Filed: Jul. 12, 1999

(51) Int. Cl.[7] ..... B02C 23/32

(52) U.S. Cl. ..... 241/19; 241/56; 241/57; 241/69; 241/79.1; 241/97; 241/275

(58) Field of Search ..... 241/275, 80, 97, 241/19, 56, 79.1, 57, 69

(56) References Cited

U.S. PATENT DOCUMENTS

| | | |
|---|---|---|
| 293,047 | 2/1884 | Mackey . |
| 911,913 | 2/1909 | Snyder et al. . |
| 1,524,651 | 2/1925 | Hapgood . |
| 2,752,097 | 6/1956 | Lecher . |
| 3,690,571 | 9/1972 | Luthi et al. . |
| 5,280,857 | 1/1994 | Reichner . |
| 5,695,130 | 12/1997 | Csendes . |
| 5,826,807 | 10/1998 | Csendes . |
| 5,850,977 | 12/1998 | Csendes . |

*Primary Examiner*—Mark Rosenbaum
(74) *Attorney, Agent, or Firm*—Edward A. Sokolski

(57) ABSTRACT

A cylindrical chamber has a drive shaft rotatably mounted therein and extending along substantially the entire longitudinal extent thereof. This drive shaft is rotatably driven by a motor at a speed of 1,500–10,000 rpm. Solid particles to be comminuted which may be of coal, limestone/dolomite, cement or lime are fed into the chamber. Pressurized air is fed into the bottom of the chamber. Uplifting pressure for driving the gas and particles upwardly in the chamber may be provided by pressurized gas fed in through a tangential inlet in conjunction with a stationary velocity head. The upwardly driven particles are first driven through a plurality of short arm rotors which are driven by the shaft and provide a centrifugal force which comminutes the particles. The particles are then driven through a plurality of semi-permeable screens which are rotatably driven by the shaft and further comminute the particles. High apex flow enhancers are installed along the walls of the chamber to enhance the fluid flow. The fully comminuted particles are expelled from the top end of the chamber.

10 Claims, 9 Drawing Sheets

METHOD AND APPARATUS FOR COMMINUTING SOLID PARTICLES

BACKGROUND OF THE INVENTION

1. Field of the Invention

This invention relates to a method and apparatus for comminuting solid particles and more particularly to such a method and apparatus which utilizes pressurized gas to drive the particles upwardly in a chamber through rotors and rotating semipermeable screens which perform the comminuting action.

2. Description of the Related Art

Micronized limestone is used in agriculture, industrial fillers, environmental controls and the construction trade. Micronized cement is useful in the building industry.

Micronized coal is used as an energy source in the generation of electricity and micronized limestone/dolomite or lime are used for environmental compliance in the flue gas cleanup of power plants. Micronized coal burns with a flame velocity similar to natural gas or fuel oil and with a short flame that allows the heat energy generated in the combustion to be readily transferred to the water walls of the boiler. This results in an increased boiler rating and less heat losses through the ducts and flue stack. In addition to providing a more complete combustion, the micronized coal upon combustion yields a micronized fly ash with low carbon content which is of considerable value in the construction industry as a substitute for cement in high strength concrete formulations.

In addition the combustion of micronized coal requires no excess air and results in minimized NOx in the flue gases. Micronized limestone, dolomite or hydrated lime are most valuable in the dry hot scrubbing of flue gases and affords a more effective aqueous scrubbing thereof as these particles have much larger reactive surfaces for the SOx and NOx scrubbing. This results in a more complete utilization of the sorbents resulting in substantial savings in the flue gas clean up section of a power plant in conforming to the requirements of the Clean Air Act.

The use of micronized coal and limestone/dolomite or lime as the fuel for generating electric power thus has significant advantages over the use of conventional fuels such as fuel oil or non-micronized coal and is much less expensive than natural gas.

In my U.S Pat. No. 5,695,130 issued Dec. 9, 1997, a grinding system is described in which rotating screens with wide mesh openings are first used to comminute particulate material through spiral vortexes and such comminuted material is then fed to circular vortexes formed between rotating discs and stationary plates where the final grinding of the particulate material is accomplished and the final comminuted material is separated from the gas streams by centrifugal fans. The system and method of the present invention applies the basic technology of my prior patent in implementing the micronization of solid particles such as coal, limestone/dolomite, lime, and cement. The system of the present invention provides an improvement over the system of my prior patent in minimizing the erosion of the fan blades employed and lowering the system power requirements.

SUMMARY OF THE INVENTION

The device and method of the present invention achieves the above indicated improvements by providing a pressurized air drive for driving the particles upwardly along with high apex flow enhancers so that a fan for achieving this end result is not required and designing the rotors with short arms so that they do not impact on the particles but rather generate kinetic energy in the form of centrifugal vortices in the air stream.

In the system of the invention, pressurized air is fed into the bottom of a chamber into which the particles to be comminuted are fed. Uplift action is provided by means of a stationary velocity head in the form of an inverted semi-ellipsoidal tank. The particles are first comminuted by a series of short arm rotors designed to generate centrifugal vortices in the uplifting air which effect the comminuting action. Such short arm rotors have the advantages of minimizing wear and tear on the rotor blades and enabling higher operation efficiency since the particles are driven outwardly by the centrifugal force generated in the air stream and tend not to impact on the rotor blades. Further, with shorter arm rotors, the fluid bed volume is expanded. Flow enhancers in the form of vertical apex elements mounted on the inner walls of the chamber enhance the flow of gas along the walls of the chamber. The particles are then passed through a series of semi-permeable rotating screens which further effect the comminuting action. The fully comminuted particles are then driven out of the chamber to a collecting cyclone by the gas stream.

It is therefore an object of this invention to provide a system and method for comminuting particles which consumes less power and results in less wear on the fan blades employed.

It is a further object of this invention to provide a system and method for comminuting particles having higher operation efficiency;

Other objects of the invention will become apparent in view of the following description taken in connection with the accompanying drawings.

DETAILED DESCRIPTION OF THE INVENTION

Figure 1:
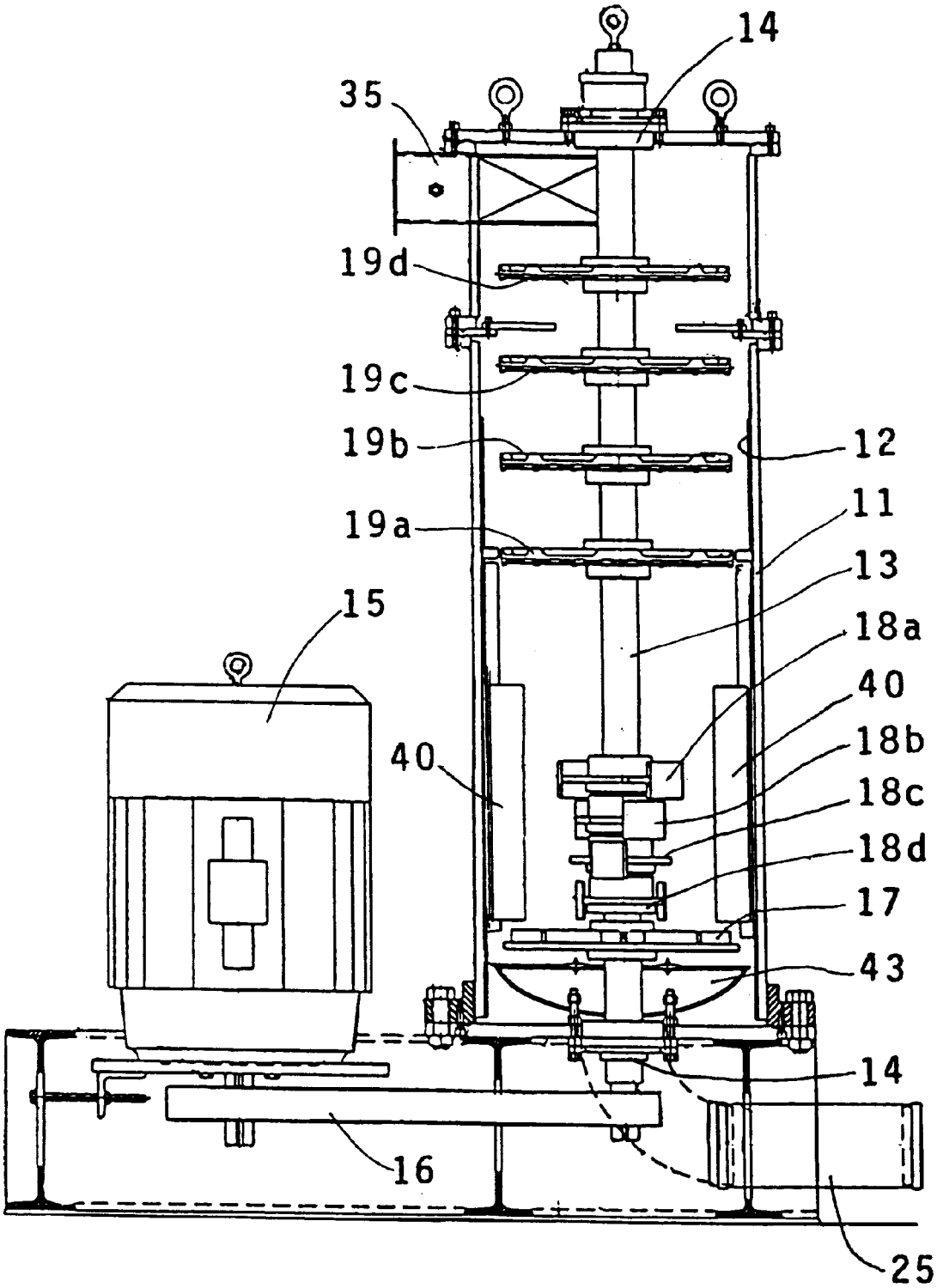
FIG. 1 is an end elevational view of a first embodiment of the system of the invention.
Figure 2:
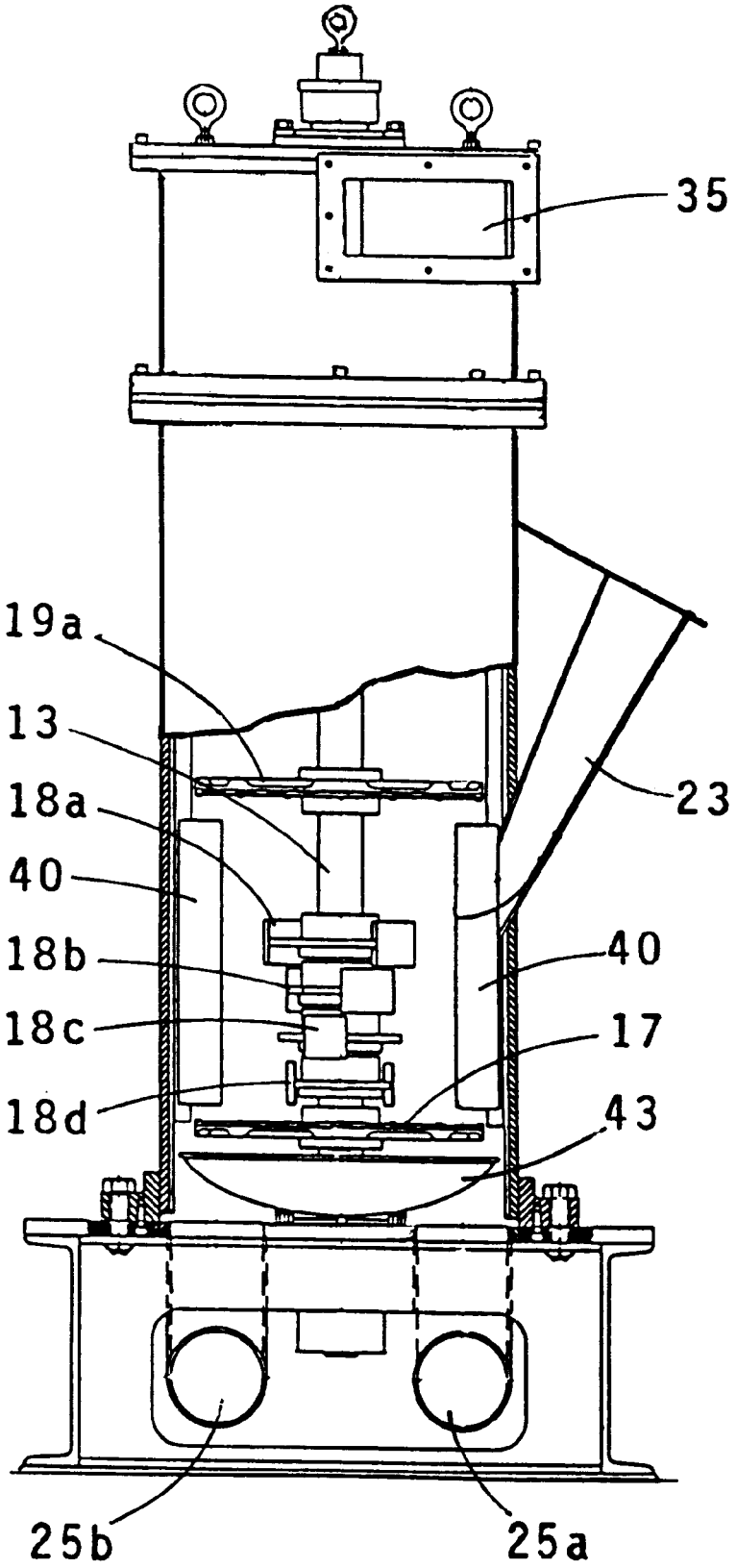
FIG. 2 is a side elevational view of the first embodiment.

Referring now to FIGS. 1–11, a first embodiment of the invention is illustrated.

Chamber 11 which is cylindrical is maintained in an air tight condition. The walls 12 of the chamber are lined with a material such as rubber or neoprene. Drive shaft 13 is mounted for rotation within the chamber on bearings 14 and is rotatably driven by motor 15 through belt drive 16 preferably at a speed of 3000–5000 rpm.

Figure 10:
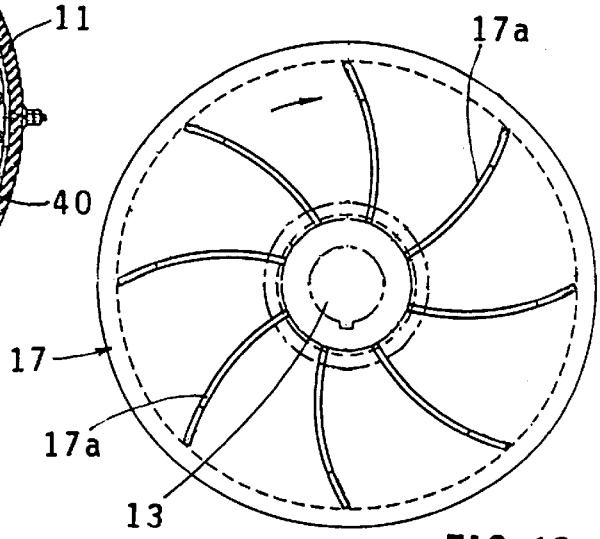
FIG. 10 is a top plan of the rotating plate employed in the system of the invention.
Figure 9:
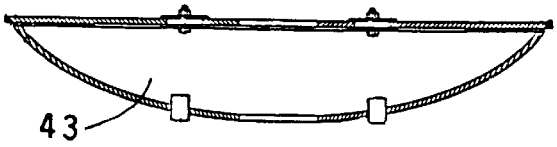
FIG. 9 is a side elevational view of the stationary velocity head employed in the system of the invention.
Figure 11:
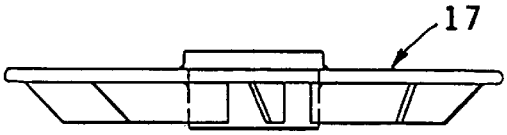
FIG. 11 is a side elevational view of the rotating plate of FIG. 10.

Connected to shaft 13 for rotation therewith are rotating plate fan 17, rotors 18*a*–18*d* and semipermeable screens 19*a*–19*d*. Fan 17, as can be seen in FIGS. 10 and 11 has curved blades 17*a* and drives particles which may fall to the bottom sideways into the uplifting airstream for regrinding. High apex flow enhancers 40 which are triangular in cross section are installed along the inner walls of the chamber, running vertically therealong and act to enhance the flow of gas along the walls of the chamber. Stationary velocity head 43, which has the shape of a semi-ellipsoidal tank is installed at the bottom of the chamber.

Solid particles which may be of coal, cement clinker, or limestone on the order of ¼" in diameter which may have a surface moisture content of 2–10% are fed from a feed hopper(not shown) by means of a screw feeder (not shown) into feed channel 23.

Pressurized gas(preferably air) is fed from inlet tubing 25 through a pair of ports 25*a* and 25*b* into the bottom of the chamber. The pressurized air is distributed upwardly by velocity head 43 in the form of an annulus providing a uniform air curtain directed upwardly along the inner wall of chamber 11.

Figure 6:
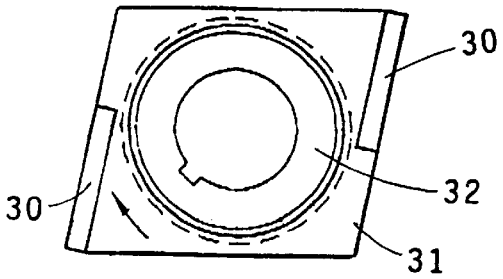
FIG. 6 is a top plan view of one of the short arm rotors utilized in the system of the invention.
Figure 7:
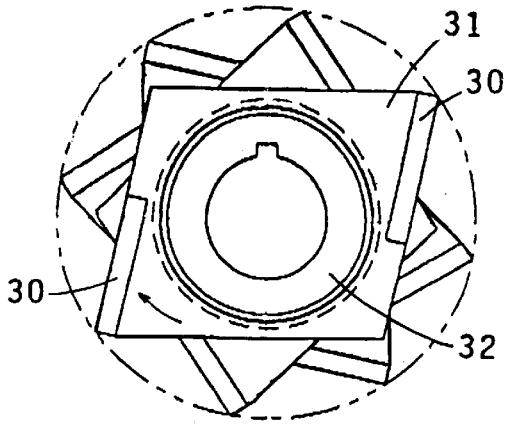
FIG. 7 is a top plan view showing a plurality of short arm rotors utilized in the system of the invention mounted on the drive shaft employed in the system of the invention.
Figure 8:
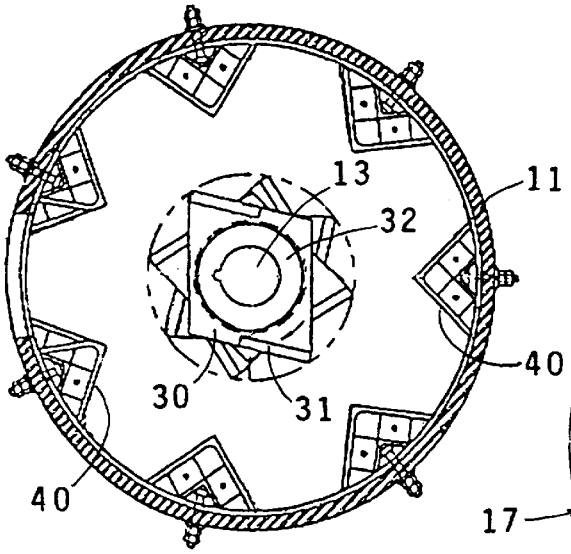
FIG. 8 is a top plan view of a plurality of the short arm rotors of FIG. 7 mounted within the system chamber.

Rotors 18*a*–18*d* are shown in FIGS. 6–8. The rotor blades 30 are vertical and are angled with respect to the longitudinal axis of rotor arms 31 by an angle of about sixty degrees. The blades are connected to shaft 13 by means of shaft attachment 32. The rotor arms are quite short and the design of the rotors is such that they do not impact on the particles in the fluid bed but rather transmit the kinetic energy which they generate into the air stream between the rotor blades and the inner wall of the chamber which performs the comminuting action by virtue of the centrifugal forces generated in this air stream. The rotors are shown installed in chamber 11 in FIG. 8. High apex flow enhancers 40 which extend vertically, as shown in FIG. 1, enhance the flow of the air stream along the inner surfaces of the chamber. As the particles decrease in size, the effect of the centrifugal forces decreases, and the flow dynamics carries the reduced size particles towards the rotating semi permeable screens 19*a*–19*d*. The slower moving larger particles are repulsed by the screens and driven back down for regrinding. The smaller particles which pass through the screens are exposed to the vertical spiral air vortexes created by the rotating screens. The comminuted particles are expelled to a collecting cyclone through outlet 35.

Figure 3:
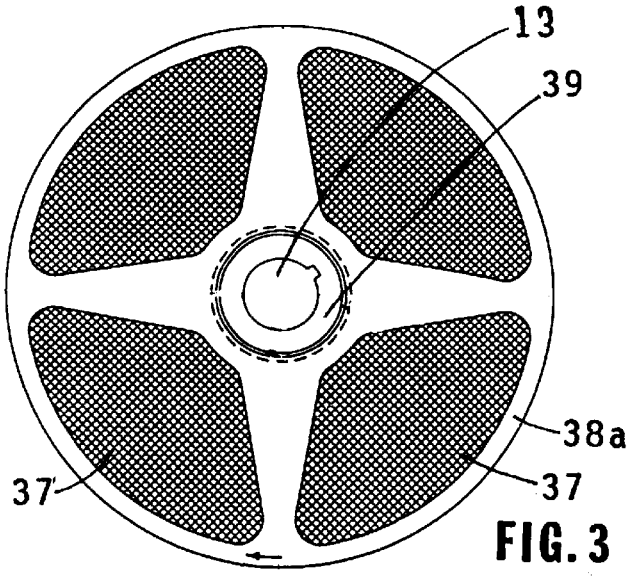
FIG. 3 is a top plan view of one of the semi permeable screens used in the device of the invention.
Figure 4:
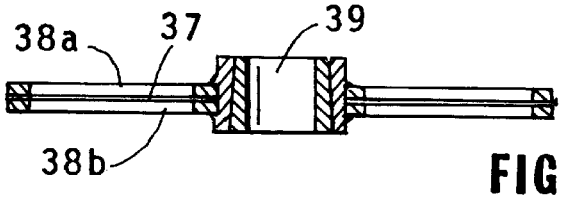
FIG. 4 is an end elevational view of the screen of FIG. 3.
Figure 5:
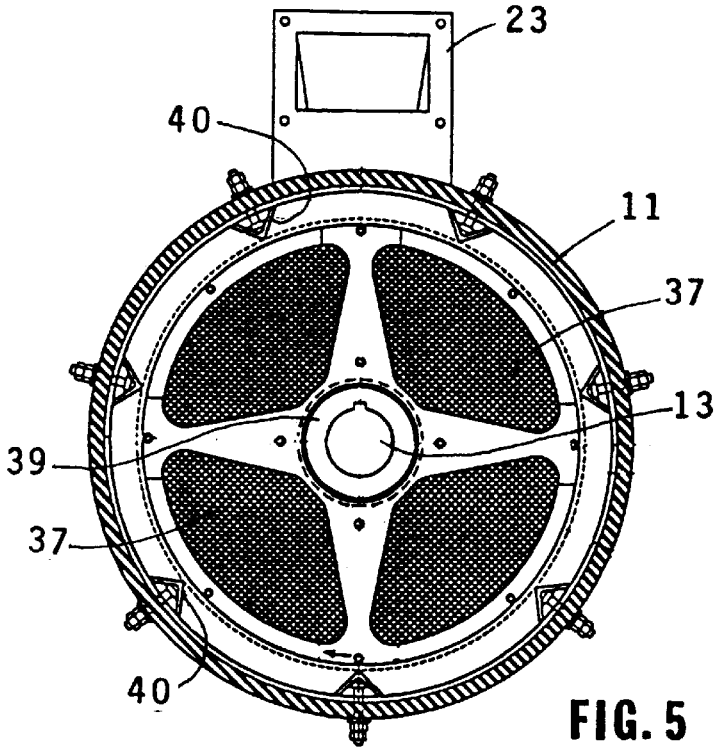
FIG. 5 is a top plan view of one of the screens of FIG. 3 installed in the chamber of the system of the invention.

The structure of the semi permeable screens is illustrated in FIGS. 3–5. Wire screens 37, which are preferably about 4 mesh, are sandwiched between holder frames 38*a* and 38*b*, these holder frames being coupled to drive shaft 13 by means of shaft attachment 39. FIG. 5 shows one of the screens installed in the chamber 11. Vertical flow enhancers 40 (also shown in FIG. 1) are installed in the walls of the chamber to enhance the flow of fluid.

Figure 12:
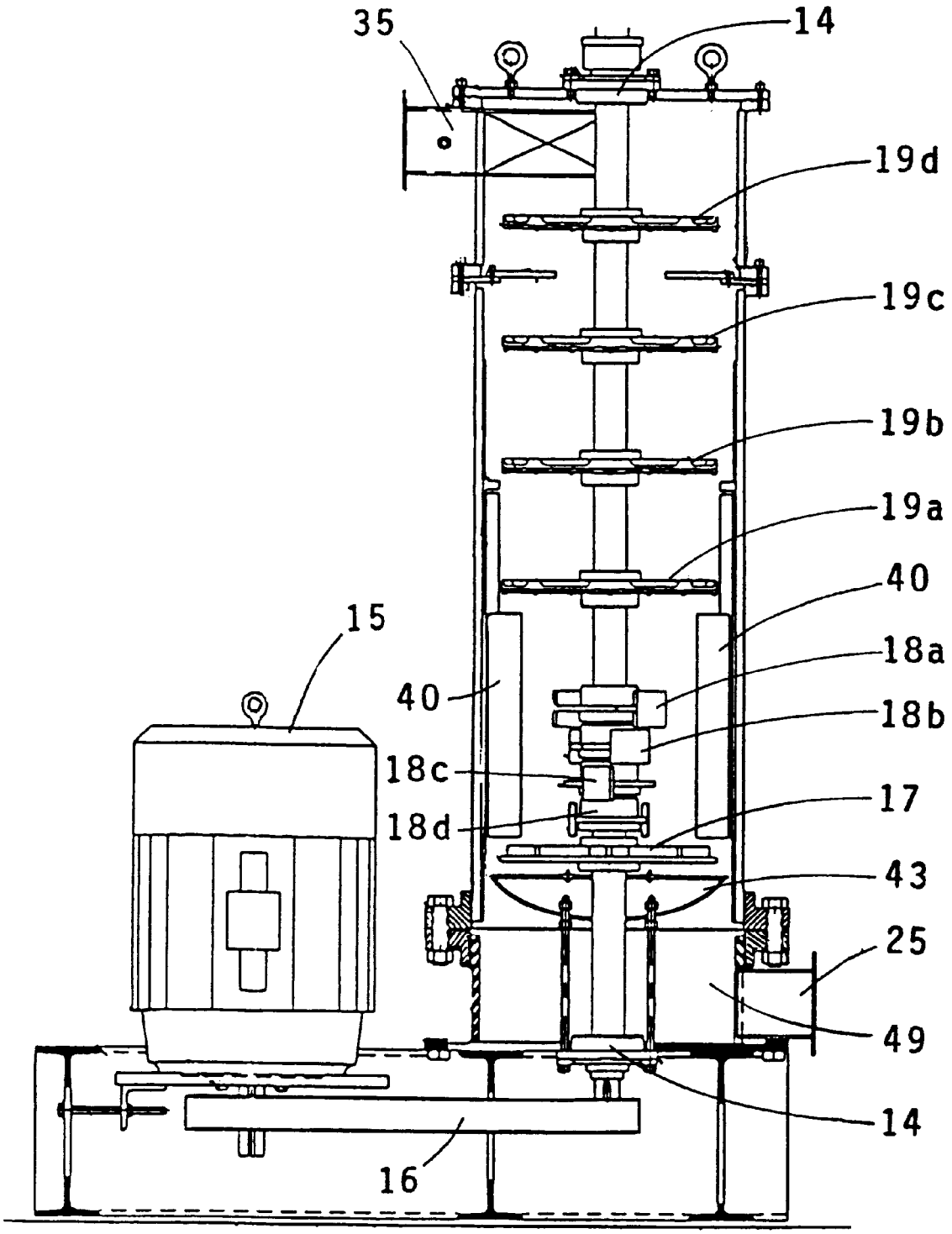
FIG. 12 is an end elevational view of a second embodiment of the system of the invention.
Figure 13:
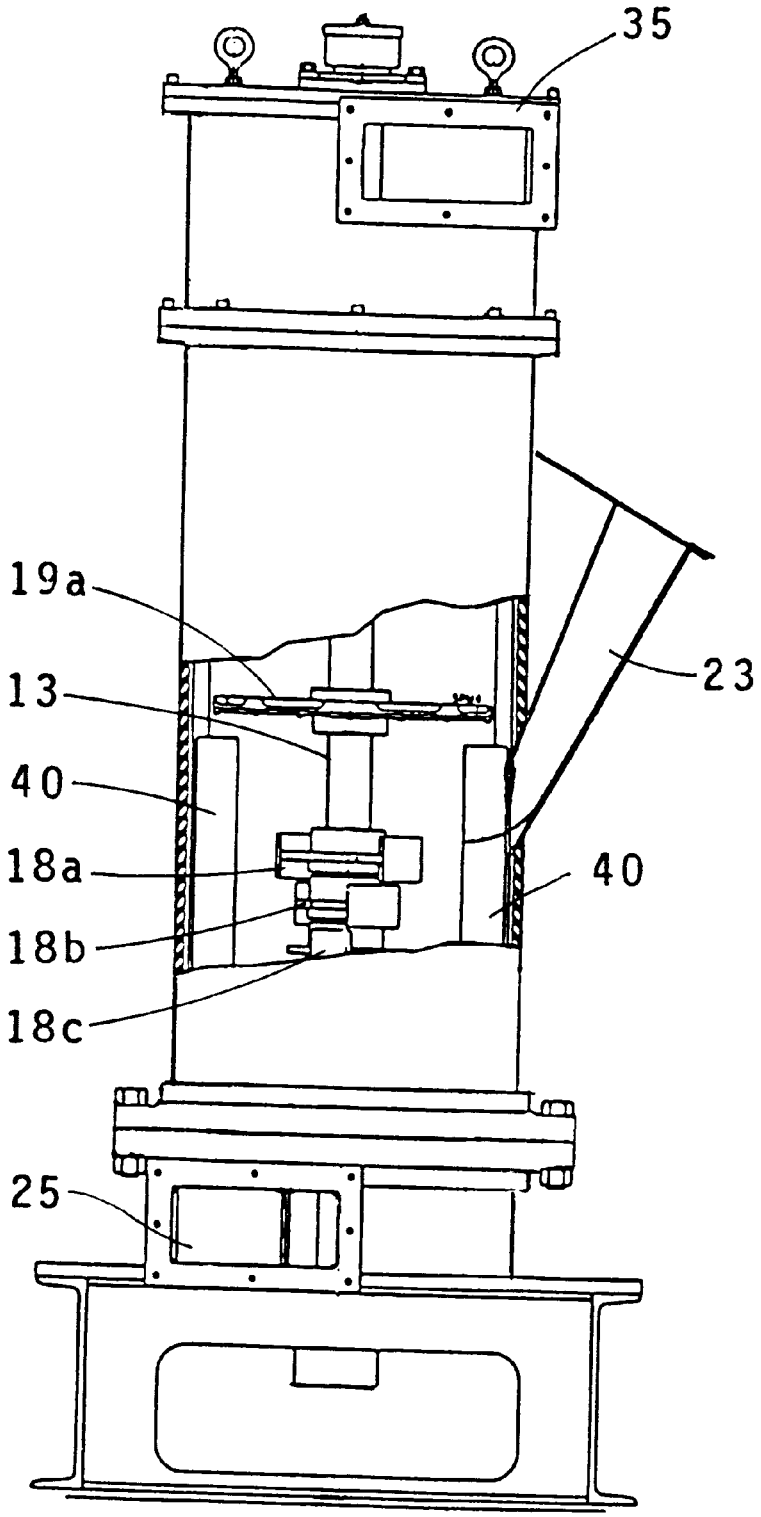
FIG. 13 is a side elevational view of the second embodiment.
Figure 14:
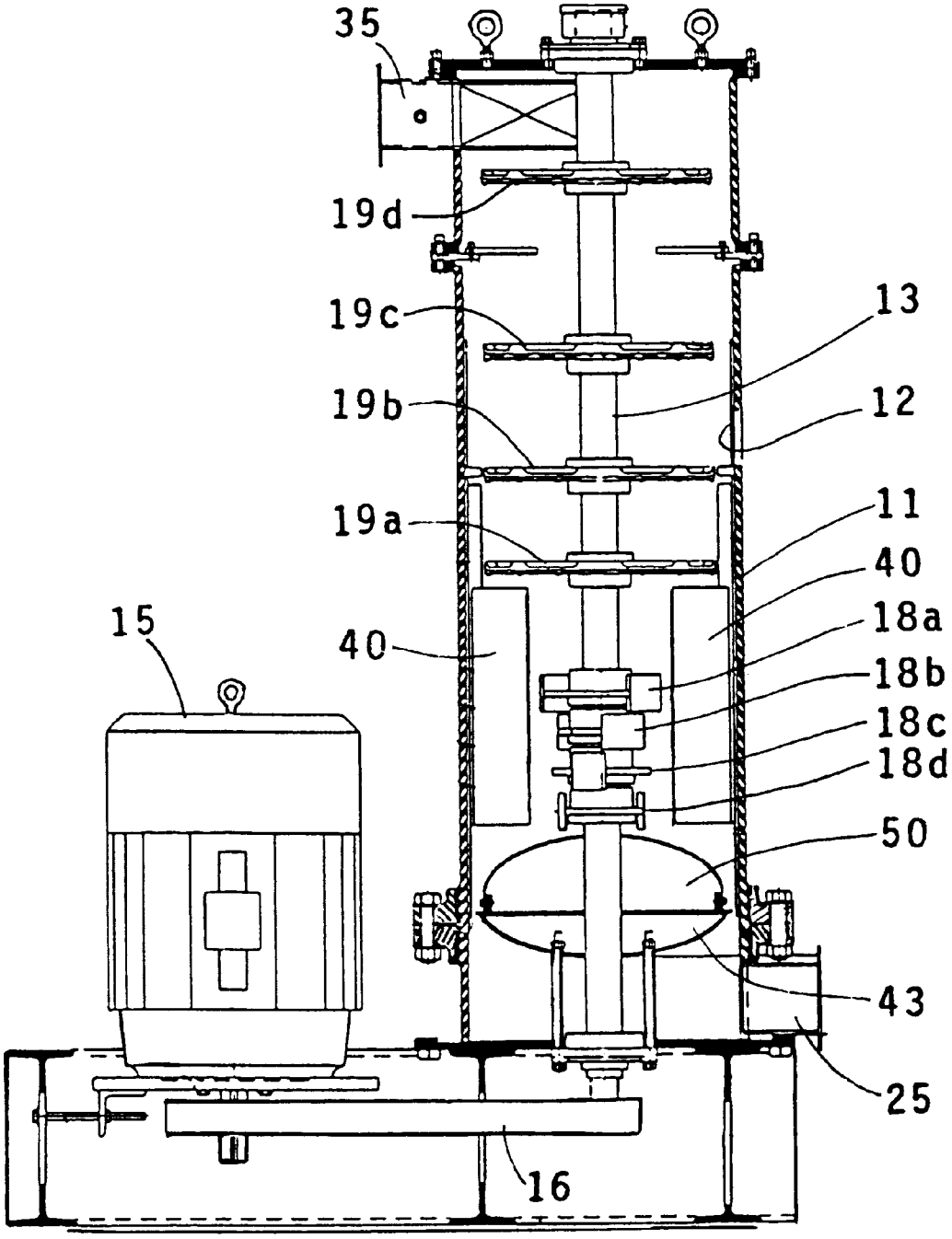
FIG. 14 is an end elevational view of a third embodiment of the system of the invention.

Referring now to FIGS. 12 and 13, a second embodiment of the invention is shown. This second embodiment is the same as the first except for the addition of an additional section to the bottom of the chamber in which a tangential inlet is installed that makes for a circular flow. Pressurized air is fed into the bottom of the chamber by means of a forced draft fan(not shown) through tangential inlets 50. With such tangential feeding of the pressurized air into the chamber, a high velocity spiral swirl of the air stream is effected along the inner wall of chamber 11. There thus is a circular flow between the flow enhancers 40. An even radial velocity distribution results throughout the rest of the chamber. This provides a denser fluid bed which makes for improved comminution and less power consumption.

Figure 15:
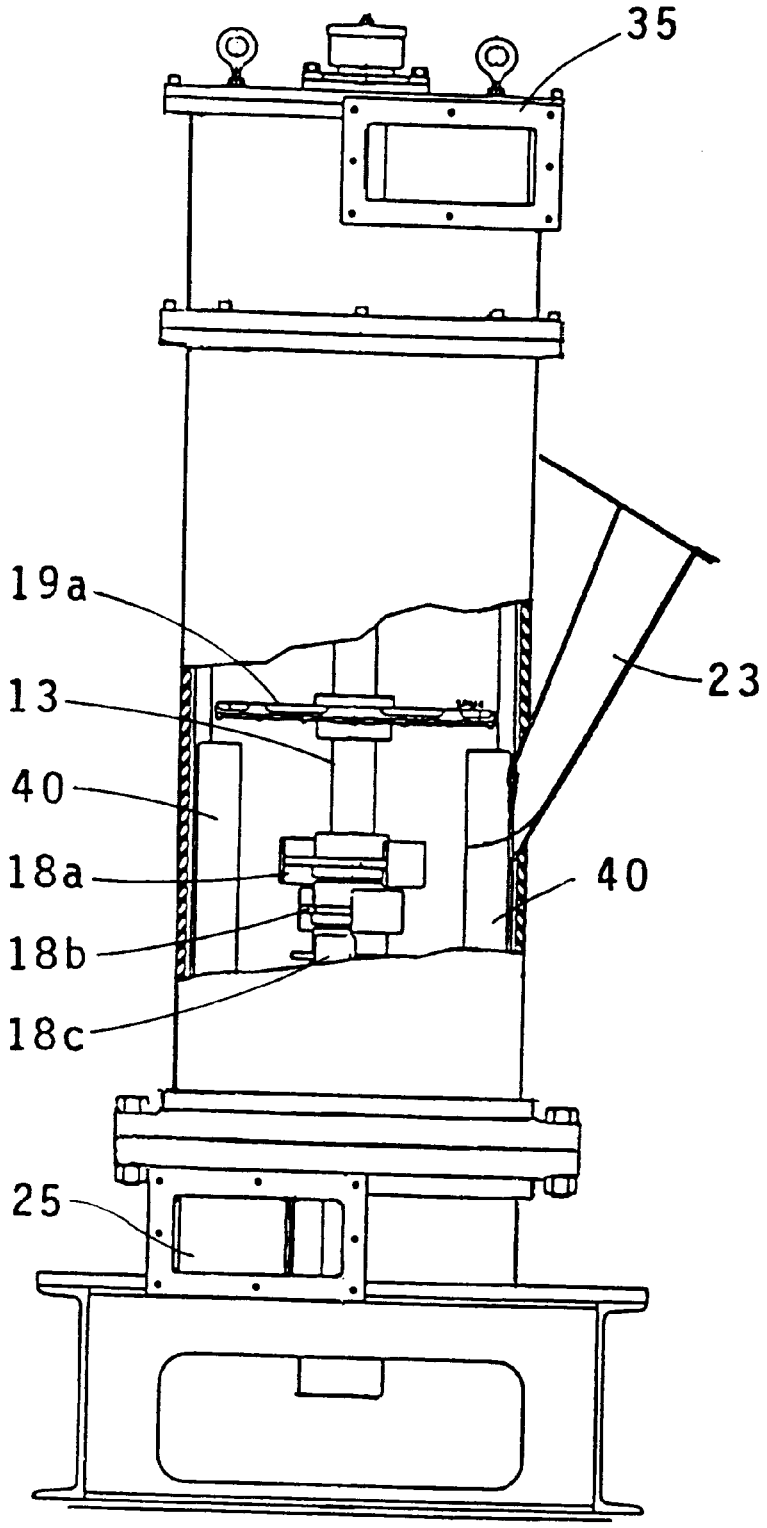
FIG. 15 is a side elevational view of the embodiment of FIG. 12.
Figure 16:
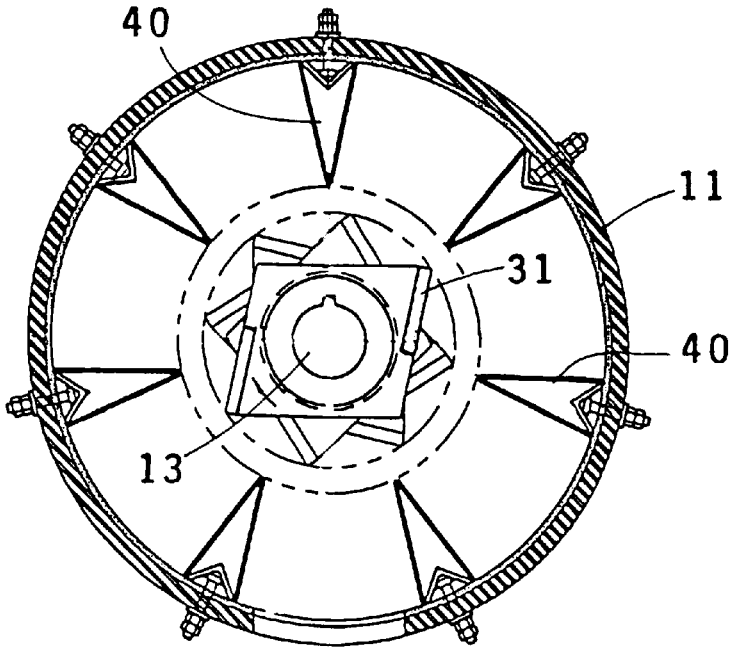
FIG. 16 is a top plan view showing a plurality of short arm rotors of the system of the invention installed in the chamber of the system of the invention along with extra high apex flow enhancers.
Figure 17:
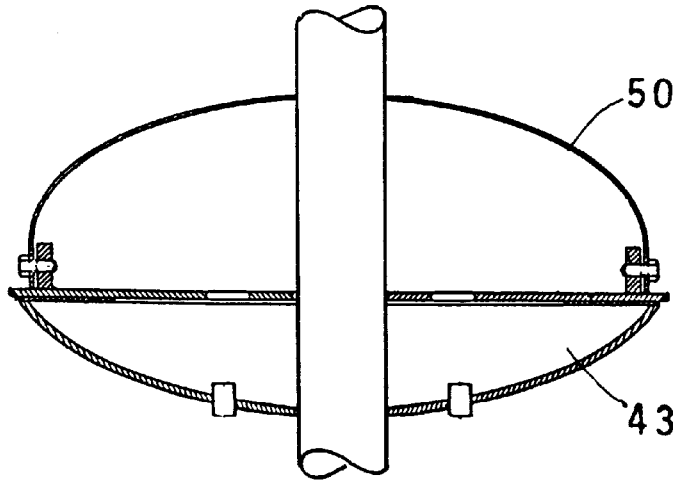
FIG. 17 is a side elevational view of the stationary velocity head of the system of the invention with a dome head cover.

Referring now to FIGS. 15–17, a third embodiment of the invention is shown. This embodiment differs from the second embodiment in the substitution of a dome head cover 50 above the stationary velocity head 43 for the rotating plate for use in upwardly driving particles falling to the bottom so they can be reground. In addition, extra high flow enhancers 40 which are elongated and have narrow bases, as shown in FIG. 16, are employed. Otherwise this embodiment is the same as the second embodiment.

While the invention has been described and illustrated in detail, it is to be clearly understood that this is intended by way of illustration and example only and not by way of limitation, the scope of the invention being only by the terms of the following claims.

I claim:

1. A system for comminuting solid particles comprising:

a chamber;

means for feeding said solid particles into said chamber;

a source of pressurized gas, gas from said pressurized source being fed into the bottom end of said chamber;

means mounted in said chamber near the bottom end thereof for providing uplifting pressure for driving said gas and said particles upwardly in the form of an annulus providing a uniform air curtain alone the inner wall of the chamber;

a rotating shaft mounted for rotation in said chamber;

a motor for rotatably driving said shaft at least one rotor mounted on the rotating shaft, said rotor generating a centrifugal driving force in the gas for comminuting the particles as they are driven upwardly past the ends of said rotor;

at least one semi permeable screen rotatably mounted in said chamber on said rotating shaft above said rotor, said particles being driven from said one rotor against said one screen with the smaller particles passing therethrough and the larger particles being driven back to said one rotor for further comminution, said one screen generating vertical spiral gas vortices which further comminute the particles; and means for expelling the comminuted particles from said chamber.

2. The system of claim 1 and including a plurality of said screens having 6–10 mesh.

3. The device of claim 1 wherein the rotational velocity of the screen and rotor is 1200–10,000 rpm.

4. The device of claim 1 and further including vertical gas flow enhancers having narrow bases installed vertically along the side walls of said chamber.

5. The system of claim 1 wherein said one rotor has arms which are oriented horizontally and blades at the ends of the arms which are oriented vertically and angulated with respect to the horizontal axes of said arms at an angle of approximately sixty degrees.

6. The system of claim 1 and further including means for feeding said pressurized gas into said chamber at an angle which is tangential to the inner walls of said chamber.

7. A method for comminuting solid particles comprising he steps of:

feeding said particles into a chamber;

feeding compressed gas into the bottom of said chamber; generating uplift pressure on said compressed gas and said particles by means of a stationary velocity head located near the bottom of the chamber to drive said gas and said particles upwardly in said chamber in the form of an annulus providing a uniform air curtain along the inner wall of the chamber;

passing said particles past the end of a plurality of rotating short arm rotors which generate centrifugal forces in the gas to comminute the particles;

further comminuting the particles by driving them through vertical spiral gas vortices generated by a plurality of rotating semi-permeable screens, with the smaller particles passing through the screens and the larger particles being driven back to the rotors for further comminution; and expelling the comminuted particles from said chamber.

8. The method of claim 7 wherein the gas is fed into the chamber at an angle which is tangential to the inner walls of the chamber to effect a high velocity spiral swirl of the gas along the chamber walls.

9. The method of claim 7 and enhancing the flow of gas along the walls of the chamber by means of a flow enhancer installed along the chamber walls.

10. The method of claim 7 and further including the step of driving particles falling to the bottom of the chamber upwardly for regrinding by means of a dome head installed near the bottom of the chamber.

* * * * *